United States Patent [19]

Mlachnik

[11] 4,237,575

[45] Dec. 9, 1980

[54] PAINT ROLLER

[76] Inventor: Albert A. Mlachnik, 6235 Fisher La., Greendale, Wis. 53129

[21] Appl. No.: 6,594

[22] Filed: Jan. 26, 1979

[51] Int. Cl.[3] ..... B05C 1/10

[52] U.S. Cl. ..... 15/230.11

[58] Field of Search ..... 15/230.11, 143, 145; 29/116 R; 401/197, 208, 218, 219, 220

[56] References Cited

U.S. PATENT DOCUMENTS

| | | | |
|---|---|---|---|
| 2,747,210 | 5/1956 | Canning et al. | 15/230.11 |
| 2,970,366 | 2/1961 | Gill | 15/230.11 X |
| 3,335,446 | 8/1967 | McGinley | 15/230.11 |
| 3,877,123 | 4/1975 | Pharris | 15/230.11 X |

FOREIGN PATENT DOCUMENTS

| | | | |
|---|---|---|---|
| 1069149 | 2/1954 | France | 15/230.11 |
| 303751 | 2/1955 | Switzerland | 15/230.11 |

*Primary Examiner*—Philip R. Coe

[57] ABSTRACT

A paint roller has a roller support member of a plastic material provided with an internal bearing surface extending for a partial distance from one end for engaging a short shaft portion of a metallic handle which couples the roller to a hand grip. Thrust support in one direction is provided by a transverse surface disposed adjacent one end of the bearing surface for engagement by one end of the shaft and a spring washer which engages the shaft and the roller support provides thrust support in the opposite direction and couples the members together. A short finned section and integrally formed washers on the roller support in the area of the bearing surface are provided for engaging a roller cover adjacent one end. The other end of the roller cover is engaged by a washer supported at one end of an axial extension projecting from the roller support body.

8 Claims, 4 Drawing Figures

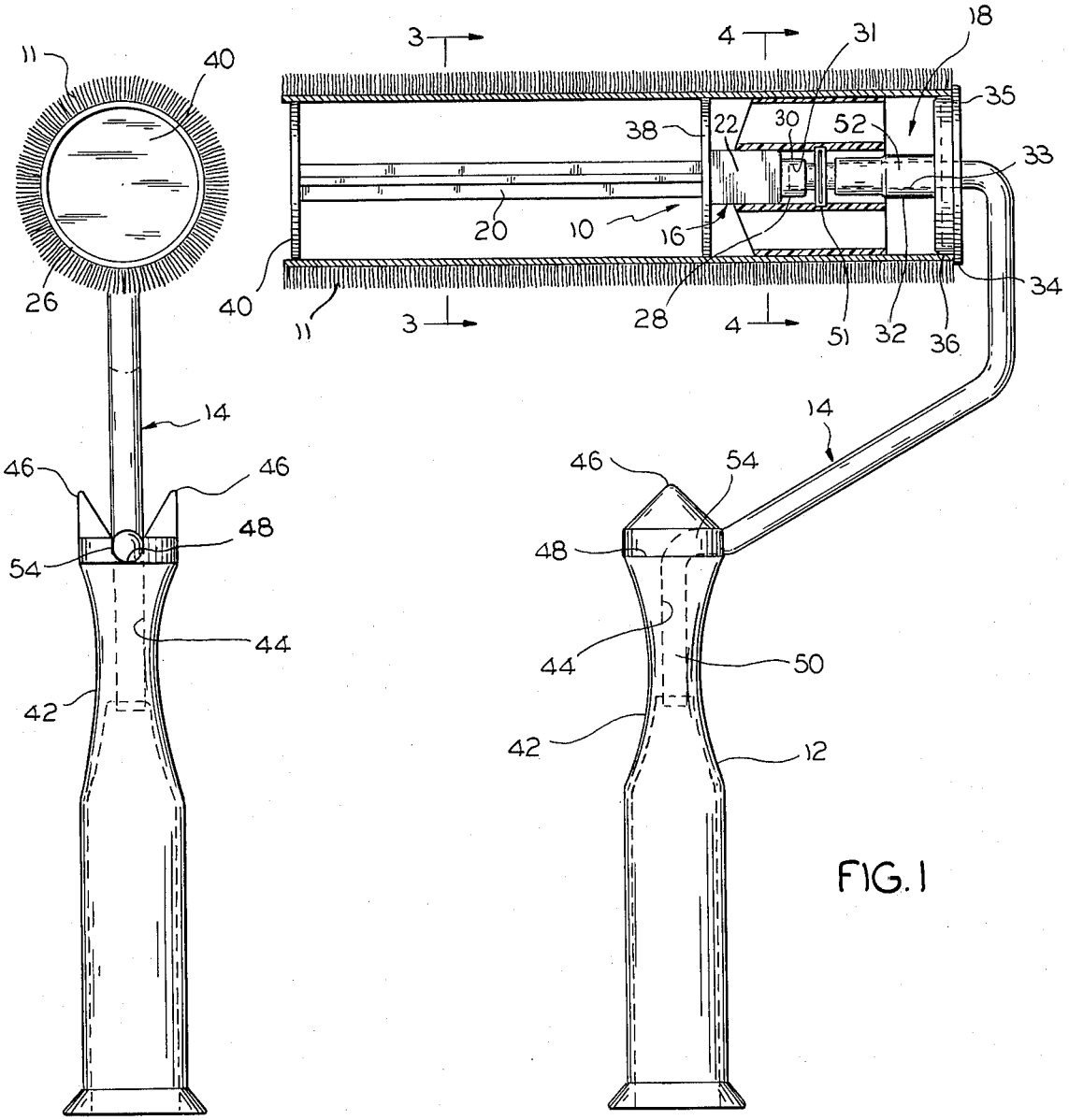
FIG. 1
FIG. 2
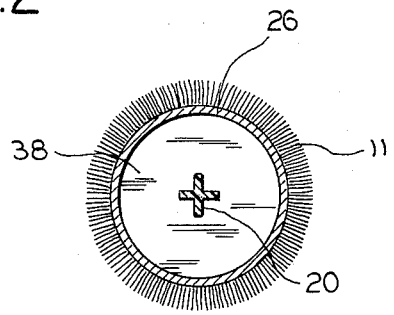
FIG. 3
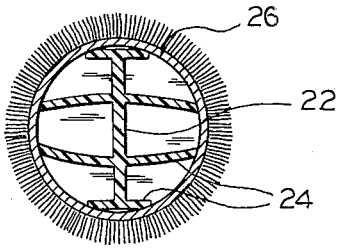
FIG. 4

PAINT ROLLER

BACKGROUND OF THE INVENTION

This invention relates to paint rollers.

Conventional paint rollers include a metallic handle and shaft for supporting a roller cover. The shaft extends coaxially through the cover and the two are generally coupled by means of end caps which are held in position on the shaft by crimping and washers. Such prior art paint rollers are not wholly satisfactory because of the expense in fabricating the metallic handle extension and support axle of sufficient length to support both ends of the roller cover and because conventional end caps did not provide adequate bearing surface.

SUMMARY OF THE INVENTION

It is an object of the invention to provide a new and improved paint roller.

Another object of the invention is to provide a paint roller having a cover support body of a plastic material mounted on a relatively short handle axle.

A further object of the invention is to provide a paint roller which is economical to manufacture and to assemble and which is relatively lightweight.

Yet another object of the invention is to provide a paint roller wherein there is a substantial bearing surface provided between the cover axle and a cover support member.

These and other objects and advantages of the invention will become apparent from the detailed description thereof taken with the accompanying drawings.

BRIEF DESCRIPTION OF THE DRAWINGS

FIG. 1 is a side elevational view with parts broken away of a paint roller according to the present invention;

FIG. 2 is an end view of the paint roller illustrated in FIG. 1;

FIG. 3 is a view taken along lines 3—3 of FIG. 1; and

FIG. 4 is a view taken along lines 4—4 of FIG. 1.

DESCRIPTION OF THE PREFERRED EMBODIMENT

The paint roller according to the invention includes a support 10 for a roller cover 11 and a hand grip 12 which is connected to support 10 by a metallic handle extension 14. Support 10 is formed of any suitable plastic material, such as polyethylene or polypropylene, for example, and includes a body 16 and a pair of axial extensions 18 and 20 extending therefrom.

The body 16 includes a central rib 22 and a plurality of fins 24 extending transversely therefrom for resiliently engageing the inner surface of the roller cover 11. Formed in one side of the rib 22 is a rectangular central recess 28. A cup-shaped bearing 30 having an internal surface 31 is formed on fin 22 and faces recess 28. The first axial extension 18 includes a cylindrical sleeve portion 32 which is affixed to and extends along fin 22 from the recess 28. The sleeve 32 also is spaced from and coaxial with the bearing 30 and has an internal surface 33. Integral with the end of the sleeve portion 32 and coaxial therewith is an apertured end cap 34 having an inwardly facing shoulder 36 of reduced diameter and a flange 35 for respectively engaging the inner surface and the end of the roller cover 11. Also affixed coaxially to the other end of body 16 is a first stabilizing washer 38.

The second extension 20 is substantially longer than the first and has a second stabilizing washer 40 affixed coaxially at its distal end. Preferably, extension 20 has a suitable cross-sectional configuration to provide a requisite strength, such as teh cruciform shape shown in FIG. 3. It will be appreciated that the internal diameter of the shoulder portion 36, the stabilizing washers 38 and 40 and the width of the fins 24 will be such as to provide a relatively tight fit with the internal surface of the roller cover 11.

The hand grip 12 is also formed of a suitable plastic material and is generally hollow. A neck portion 42 of reduced diameter is formed adjacent the upper end of hand grip 12 and has an axial bore 44 whose opposite ends open respectively at the hollow interior of hand grip 12 and to the upper end of neck portion 42. A pair of ears 46 project longitudinally from the end of neck portion 42 and are spaced apart a distance equal to the diameter of the handle extension 14 to define a groove 48 at the upper end of hand grip 12 and extending normally to the bore 44.

The handle extension 14 includes a first end portion 50 received within the bore 44 of hand grip 12 and a second end portion 52 received within the bearing 30 and the sleeve portion 32 of support body 16. Additionally, there is a first 90° bend in handle extension 14 adjacent end portion 50 to provide a relatively short portion 54 extending laterally therefrom and which lies within groove 48. End portion 50 and short portion 52 are press fit into bore 44 and bearing 30, respectively, so that the handle extension 14 is prevented from sliding outwardly of hand grip 12. In addition, the engagement of portion 54 and groove 48 prevents rotation of handle extension 14 in bore 44.

The end portion 52 extends with its axis generally normal to the axis of end portion 50 and is slidably received within sleeve 32 and bearing 30 to permit relative rotational movement therebetween. The inner surfaces 31 and 33, respectively, of bearing 30 in sleeve 32 provide sufficient bearing surface for end portion 52, which functions as a shaft so that support 10 is mounted for rotation in a relatively stabilized condition. Support 10 is maintained on shaft 52 by means of a spring washer 51 which engages shaft 52 at a point between the ends of bearing 30 and sleeve 32. The spring washer 51 also provides a thrust support relative to movement of support 10 in the axial direction relative to the shaft portion 52 and the engagement of the end of shaft 52 at the base of bearing surface 31 provides thrust support against movement in the opposite direction.

The paint roller assembly according to the present invention provides a roller support which is mounted on a relatively short shaft 52 with respect to the length of the roller cover 11, the plastic extension 20 providing support at the opposite end of the cover 11. Accordingly, a shaft extending the full length of the roller cover is not required. In addition, the roller support 10 and the hand grip 12 are coupled to the handle extension 14 without the necessity for crimping. In this manner, the roller is relatively inexpensive to fabricate and assemble.

While only a single embodiment of the invention is illustrated and described, it is not intended to be limited thereby but only by the scope of the appended claims.

I claim:

1. A paint roller including an elongate roller support formed of a plastic material and for engaging and supporting a roller cover and handle means, said roller support being substantially equal in length to said cover and having a body portion adjacent one end, said body portion including first cover engaging means and means defining an internal bearing extending from one end of the body portion a distance along the longitudinal axis of said roller support said distance being substantially shorter in length than that of said body portion, said bearing being open at one end, fixed surface means formed intermediate the ends of the body portion and disposed adjacent to the other end of said bearing and lying along the axis thereof, a metallic shaft extending into said bearing and extending from said open end to said surface means to define a shaft portion which is substantially shorter than said body portion, a recess formed in said body portion, and a coupling washer disposed in said recess for engaging said shaft portion intermediate its ends and said body portion for retaining said roller support on said shaft portion, said roller support including an elongate axial extension projecting from the body portion and being integral therewith and having second cover engaging means adjacent its remote end, said axial extension being longer than said body portion.

2. The paint roller set forth in claim 1 wherein said bearing comprises an internal cylindrical surface formed in said body portion, said surface means defining the end of said bearing surface and being engaged by the end of said shaft to define a thrust bearing therefor.

3. A paint roller including an elongate roller support formed of a plastic material and for engaging and supporting a roller cover and handle means, said roller support being substantially equal in length to said cover and having a body portion adjacent one end, said body portion including first cover engaging means and means defining an internal bearing extending from one end of the body portion a distance along the longitudinal axis of said roller support, said distance being substantially shorter in length than said roller support, said bearing being open at one end, fixed surface means disposed adjacent the other end of said bearing and lying along the axis thereof, a metallic shaft extending into said bearing and from said open end to said surface means to define a shaft portion which is also substantially shorter than said roller support, and coupling means for engaging said shaft portion and said roller support for retaining said roller support on said shaft portion, said roller support including an elongate axial extension projecting from said body portion and having second cover engaging means adjacent its remote end, said axial extension being longer than said body portion, handle means comprising a metallic member having a first end portion engageable with a hand grip and a second end portion which defines said shaft portion, and a hand grip having an axial bore for receiving said first end portion, a transverse recess formed in the end of said hand grip, said handle means having a laterally extending portion adjacent the first end portion and disposed within said recess to prevent rotation of said handle means in said axial bore.

4. The paint roller set forth in any of claim 3 wherein said surface means comprises means defining a cup-shaped surface coaxial with said bearing surface for receiving the end of said shaft portion.

5. The paint roller set forth in any of claim 4 wherein said coupling means comprises a resilient member which engages said shaft portion in the region of said bearing and intermediate the ends thereof.

6. The paint roller set forth in claim 5 wherein said first and second cover engaging means are relatively circular and further including resilient cover engaging means on said body portion.

7. The paint roller set forth in claim 6 and including additional cover engaging means at the opposite end of said body portion and disposed in concentric surrounding relation to the end of said bearing.

8. The paint roller set forth in claim 7 wherein said axial extension intersects the axis of the first end portion of said handle means.

* * * * *